US005483717A

United States Patent [19]

Chikaki

[11] Patent Number: 5,483,717

[45] Date of Patent: Jan. 16, 1996

[54] CLEANING SYSTEM USING ACRYLIC EMULSION FOR SEMICONDUCTOR WAFERS

[75] Inventor: Shinichi Chikaki, Tokyo, Japan

[73] Assignee: NEC Corporation, Japan

[21] Appl. No.: 317,196

[22] Filed: Oct. 3, 1994

[30] Foreign Application Priority Data

Oct. 5, 1993 [JP] Japan ..... 5-273121

[51] Int. Cl.[6] ..... B08B 1/02; B08B 3/02; B08B 7/04

[52] U.S. Cl. ..... 15/3; 134/902

[58] Field of Search ..... 15/1, 3, 4, 97.1, 15/102, 104.002; 134/902

[56] References Cited

U.S. PATENT DOCUMENTS

| | | | |
|---|---|---|---|
| 2,937,390 | 5/1960 | Bolton et al. | 15/3 |
| 3,079,619 | 3/1963 | Conrose | 15/1 |
| 3,839,952 | 9/1974 | Mogford | 15/104.002 |
| 3,914,817 | 10/1975 | Lindsay | 15/3 |
| 4,009,047 | 2/1977 | Lindsay | 15/3 |
| 4,982,469 | 1/1991 | Nishiwaki | 15/3 |
| 5,138,390 | 8/1992 | Miyabayashi et al. | 15/256.51 |
| 5,198,292 | 3/1993 | Lerner et al. | 15/104.93 |

FOREIGN PATENT DOCUMENTS

| | | | |
|---|---|---|---|
| 136848 | 10/1980 | Japan | 15/3 |
| 63-204728 | 8/1988 | Japan . | |

OTHER PUBLICATIONS

Partial translation of Japanese Patent Publication of Unexamined Application No. 63–204728.

*Primary Examiner*—Mark Spisich
*Attorney, Agent, or Firm*—Laff, Whitesel, Conte & Saret, Ltd.

[57] ABSTRACT

A cleaning apparatus has a roller unit coated with an adhesive layer formed from acrylic emulsion for eliminating contaminants from a surface of a semiconductor wafer and a washing unit for washing away a piece of adhesive substance left on the surface of the semiconductor wafer, and the adhesive layer formed from acrylic emulsion is so large in tackiness and hydrophilic that the cleaning apparatus removes not only large but also micro particles without residue of the adhesive substance on the surface of the semiconductor wafer.

8 Claims, 2 Drawing Sheets

CLEANING SYSTEM USING ACRYLIC EMULSION FOR SEMICONDUCTOR WAFERS

FIELD OF THE INVENTION

This invention relates to a cleaning system for semiconductor wafers and, more particularly, to a cleaning system using acrylic emulsion for cleaning semiconductor wafers.

DESCRIPTION OF THE RELATED ARTS

The integration density of semiconductor integrated circuit devices such as a microprocessor and memory devices is progressively increased, and surface contaminants or micro particles destroy the miniature circuit components of the semiconductor integrated circuit devices. A cleaning process eliminates the surface contaminants from the surfaces of the semiconductor integrated circuit devices, and relieves the semiconductor integrated circuit devices from the damage.

One of the cleaning technologies is disclosed by Werner Kern et al. in "Cleaning Solutions Based on Hydrogen Peroxide for use in Silicon Semiconductor Technology". According to the paper, the cleaning is carried out by using solution regulated to 5-1-1 parts by volume of $H_2O$—$NH_2O_2$—$NH_4OH$ at 80 degrees in centigrade, 6-1-1 parts by volume of $H_2O$—$H_2O_2$—HCl at 80 degrees in centigrade or hydrogen fluoride. The solutions are ionized, and the repulsion remove the micro particles charged identical in polarity with the semiconductor wafers. The solution further dissolves the micro particles, and the semiconductor wafer is cleaned through these phenomena.

Another prior art cleaning technology is disclosed in Japanese Patent Publication of Unexamined Application No. 63-204728. The Japanese Publication teaches an elimination of contaminants from a surface of a package by using an adhesive rubber roller. Namely, the semiconductor devices sealed in the packages are sequentially brought into a rotating surface of the adhesive rubber roller, and the contaminants are adhered to the rotating surface. Thus, the contaminants are physically eliminated from the surface of the packages.

However, problems are encountered in the prior art cleaning technologies as follows.

First, the first prior art cleaning technology breaks metal wirings, because the solutions are erosive. If the metal wirings are directly exposed to the solution, the metal wirings are violently eroded by the solution. Even through the metal wirings are covered with a silicon oxide layer, the solution penetrates the silicon oxide layer, and attacks the metal wirings. Therefore, the first prior art cleaning technology is not used for an intermediate structure of the semiconductor device, and the solution is causative of the secondary contamination left in the semiconductor device.

The second prior art cleaning technology is effective against large particles. However, micro particles hardly adhere to the rubber roller, and a piece of rubber tends to be left on the surface. The piece of rubber left on the surface is a secondary concomitant hardly washed away in water, and, for this reason, the second prior art cleaning technology is hardly used for a semiconductor wafer.

SUMMARY OF THE INVENTION

It is therefore an important object of the present invention to provide a cleaning apparatus which is free from the problems inherent in the prior art cleaning technologies.

To accomplish the object, the present invention proposes to eliminate contaminants from a surface of a semiconductor wafer by the agency of acrylic emulsion.

In accordance with one aspect of the present invention, there is provided a cleaning apparatus comprising an absorbent unit having an adhesive layer of acrylic emulsion brought into contact with a surface of a semiconductor wafer for eliminating contaminants from the surface of the semiconductor wafer.

In accordance with another aspect of the present invention, there is provided a cleaning apparatus comprising: a) an absorbent unit having an adhesive layer of acrylic emulsion brought into contact with a surface of a semiconductor wafer for eliminating contaminants from the surface of the semiconductor wafer; b) a washing unit operative to wash away pieces of the acrylic emulsion left on the surface of the semiconductor wafer after the elimination of the contaminants; and c) a conveying unit for transferring the semiconductor wafer through the absorbent unit and the washing unit.

BRIEF DESCRIPTION OF THE DRAWINGS

The features and advantages of the cleaning apparatus according to the present invention will be more clearly understood from the following description taken in conjunction with the accompanying drawings in which.

DESCRIPTION OF THE PREFERRED EMBODIMENTS

First Embodiment

Figure 1:
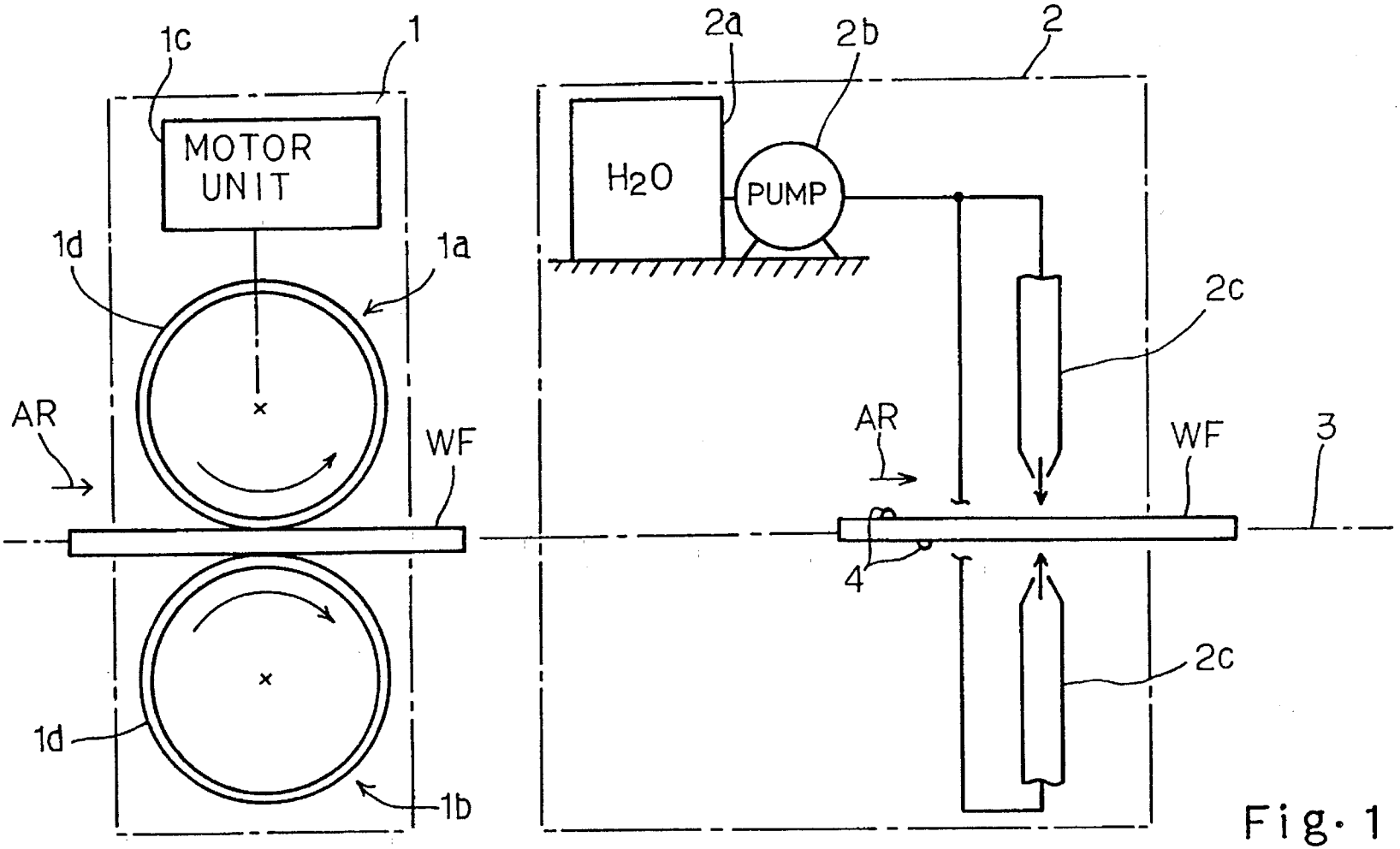
FIG. 1 is a schematic view showing a cleaning apparatus according to the present invention.

Referring first to FIG. 1 of the drawings, a cleaning apparatus embodying the present invention largely comprises an absorbent unit 1 provided upstream of the apparatus, a washing unit 2 provided downstream of the apparatus and a conveying mechanism 3 passing through the absorbent unit 1 and the washing unit 2 for transferring semiconductor wafers WF in a direction indicated by arrows AR.

The absorbent unit 1 comprises a pair of rollers 1*a* and l*b* rotatably supported by a frame (not shown) and a motor unit l*c* for driving the pair of rollers 1*a* and l*b* for rotation. The rollers 1*a* and l*b* are spaced apart form one another, and form a gap therebetween. The semiconductor wafers WF pass through the gap, and are brought into contact with outer surfaces of the rollers 1*a* and l*b*.

The rollers 1*a* and l*b* are coated with highly adhesive acrylic emulsion, and adhesive layers l*d* of the acrylic emulsion adhere to particles on the surfaces of each semiconductor wafers WF. The adhesive layers 1*d* are formed by coating the outer surfaces of the roller members with emulsion containing acrylic acid and 2-ethylhexyl alcohol, and the emulsion is dried for enhancing the viscosity. Methyl acrylate, ethyl acrylate and butyl acrylate are available for producing the acrylic emulsion.

The acrylic emulsion is so large in tackiness that the adhesive layers 1*d* adhere to not only large particles but also micro particles, and the particles are effectively transferred from the surfaces of the semiconductor wafers WF to the adhesive layers 1*d*. Moreover, the acrylic emulsion is rich enough in hydrophilic property to be washed away in water.

The washing unit 2 comprises a reservoir tank 2*a* for pure water, a pump 2*b* for pressurizing the pure water and a pair of nozzles 2*c* for injecting the pure water toward the semiconductor wafers WF. The nozzles 2*c* are spaced apart from one another, and the semiconductor wafers WF passes through the gap between the nozzles 2*c* so as to wash away pieces 4 of the acrylic emulsion adhered to the surfaces of the semiconductor wafers WF.

As described hereinbefore, the acrylic emulsion is hydrophilic. Even if the pieces of acrylic emulsion are solid, the solid piece of acrylic acid and the 2-ethylhexyl alcohol is converted to the emulsion in the pure water, and the pure water can wash away the acrylic emulsion from the surfaces of the semiconductor wafers WF.

Moreover, the acrylic emulsion does not react with metal such as aluminum, and hardly penetrates a passivation layer of a semiconductor device. For this reason, metal wirings are not eroded in the cleaning process according to the present invention.

In operation, the motor unit 1*c* drives the rollers 1*a* and 1*b* for rotation, and the semiconductor wafers WF are successively transferred to the absorbent unit 1 by the conveying mechanism 3. While each of the semiconductor wafers WF is passing through the gap between the rollers 1*a* and 1*b*, both surfaces of the semiconductor wafer WF are pressed against the adhesive layers 1*d*, and contaminants such as particles adhere to the adhesive layers 1*d*. Even if the surface of the semiconductor wafer WF is not flat due to the circuit components fabricated thereon, the adhesive layers 1*d* are deformed, and the particles are eliminated from micro-recesses formed in the surface of the semiconductor wafer WF. Moreover, a warped semiconductor wafer WF is reformed by the rollers 1*a* and 1*b*.

The conveying mechanism 3 transfers the semiconductor wafers WF from the absorbent unit 1 to the washing unit 2. The pump 2*b* pressurizes the pure water, and supplies the pressurized pure water to the nozzles 2*c*. The nozzles 2*c* inject the pure water to the surfaces of each semiconductor wafer WF, and the pure water eliminates the pieces 4 of acrylic emulsion from the surfaces of the semiconductor wafer WF.

As will be understood from the foregoing description, the adhesive layers 1*d* produced from the acrylic emulsion effectively eliminate micro particles from the surfaces of the semiconductor wafer WF, and residual pieces are washed away from the surfaces. As a result, the semiconductor wafers are free from a secondary contamination. Moreover, the acrylic emulsion hardly penetrates a passivation layer of the semiconductor device fabricated on the semiconductor wafer, and does not break metal wirings incorporated in the semicondcutor device.

Second Embodiment

Figure 2:
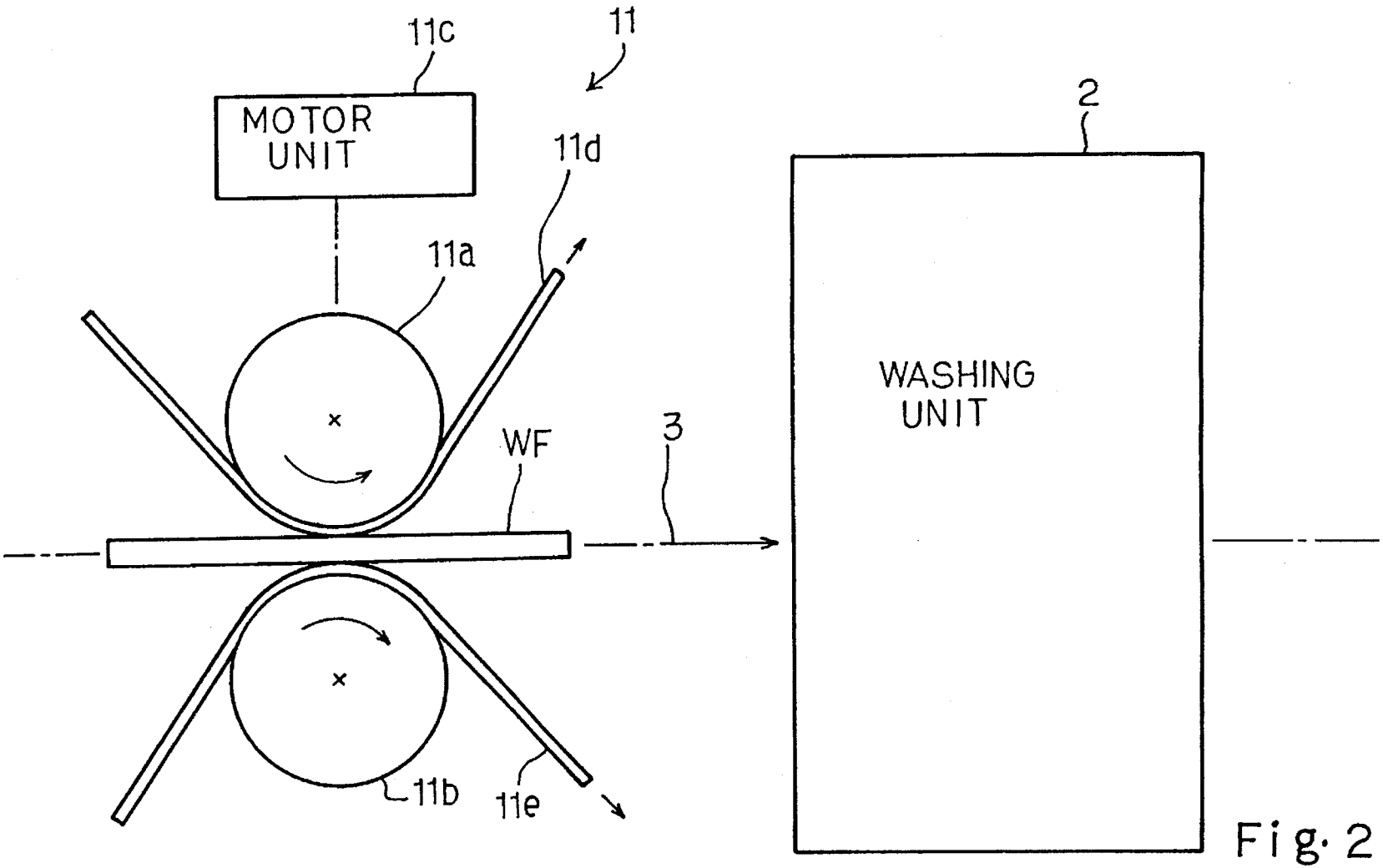
FIG. 2 is a schematic view showing another cleaning apparatus according to the present invention.

Turning to FIG. 2 of the drawings, another cleaning apparatus embodying the present invention also comprises a absorbent unit 11, a washing unit 2 and a conveying mechanism 3. The washing unit 2 and the conveying mechanism 3 are analogous to those of the first embodiment, and no further description is made on these components.

The absorbent unit 11 comprises a pair of driving rollers 11*a* and 11*b* driven by a motor unit 11*c* and a pair of flexible absorbent strips 11*d* and 11*e* guided by the driving rollers 11*a* and 11*b*, respectively. The acrylic emulsion is coated on the surface of the flexible absorbent strips 11*d* and 11*e*, and both surface of a semiconductor wafer WF are brought into contact with the adhesive layers of the acrylic emulsion. While both surfaces of the semiconductor wafer WF are pressed against the flexible absorbent strips 11*d* and 11*e*, contaminants are eliminated from the surfaces of the semiconductor wafer WF.

Each of the flexible absorbent strips 11*d* and 11*e* has a contact area wider than the outer surface of each roller 1*a* or 1*b*, and is less contaminated rather than the adhesive layers 1*d*.

Although particular embodiments of the present invention have been shown and described, it will be obvious to those skilled in the art that various changes and modifications may be made without departing from the spirit and scope of the present invention. For example, only the absorbent unit may be used for cleaning semiconductor wafers, and the washing unit may remove the residual acrylic emulsion by using another solvent.

What is claimed is:

1. A cleaning apparatus comprising:

a) an absorbent unit having an adhesive layer of acrylic emulsion, said layer being adapted to be brought into contact with a surface of a semiconductor wafer for eliminating contaminants from the surface of said semiconductor wafer;

b) a washing unit operatively connected to said absorbent unit so as to wash away residue of said acrylic emulsion left on the surface of said semiconductor wafer after the elimination of said contaminants; and c) a conveying unit for transferring said semiconductor wafer through said absorbent unit and said washing unit.

2. The cleaning apparatus as set forth in claim 1, in which said acrylic emulsion contains acrylic acid and 2-ethylhexyl alcohol.

3. The cleaning apparatus as set forth in claim 1, and a rotating roller, said adhesive layer being formed on an outer surface of said roller.

4. The cleaning apparatus as set forth in claim 3, in which there are a pair of said rollers, one of said rollers being paired with another of said rollers having an adhesive layer of acrylic emulsion along an outer surface thereof, said one roller and said another roller having a gap therebetween through which said semiconductor wafer is adapted to pass.

5. The cleaning apparatus as set forth in claim 1, in which said washing unit injects pressurized pure water to said surface of said semiconductor wafer.

6. The cleaning apparatus as set forth in claim 1, and a rotating roller, said adhesive layer being formed on an outer surface of an elongated flexible strip traveling along an outer surface of said rotating roller.

7. The cleaning apparatus as set forth in claim 6, in which there are two of said rotating rollers and two of said elongated strips, one of said elongated flexible strips being paired with another of said elongated flexible strips having an adhesive layer of acrylic emulsion along an outer surface thereof and traveling along an outer surface of another of said rotating rollers, said elongated flexible strip and said another elongated flexible strip having a gap therebetween through which said semiconductor wafer is adapted to pass.

8. A cleaning apparatus for eliminating contaminants from surfaces of a semiconductor wafer, said apparatus comprising:

a) a pair of rotating rollers having respective outer surfaces, each of said outer surfaces being coated with an adhesive layer of acrylic emulsion and forming a gap therebetween, the surfaces being pressed against said adhesive layers while said semiconductor wafer is passing through said gap, said acrylic emulsion containing acrylic acid and 2-ethylhexyl alcohol;

b) a washing unit operatively connected to said pair of rotating rollers, and having a pair of nozzles operative to inject pressurized pure water to the surfaces of said semiconductor wafer for removing residue of acrylic emulsion; and c) a conveying unit for transferring said semiconductor wafer through said pair of rollers and said washing unit.

* * * * *